US009518705B2

(12) United States Patent
Zhang et al.

(10) Patent No.: US 9,518,705 B2
(45) Date of Patent: Dec. 13, 2016

(54) LENS AND AN ILLUMINATION DEVICE HAVING THE LENS

(71) Applicant: OSRAM GmbH, Munich (DE)

(72) Inventors: Qihui Zhang, Shenzhen Guangdong (CN); HongWei Zhang, Shenzhen Guangdong (CN); Yuhua Liang, Shenzhen Guangdong (CN); Hui Gui, Shenzhen Guangdong (CN)

( * ) Notice: Subject to any disclaimer, the term of this patent is extended or adjusted under 35 U.S.C. 154(b) by 129 days.

(21) Appl. No.: 14/371,741

(22) PCT Filed: Jan. 3, 2013

(86) PCT No.: PCT/EP2013/050063
§ 371 (c)(1),
(2) Date: Jul. 11, 2014

(87) PCT Pub. No.: WO2013/104556
PCT Pub. Date: Jul. 18, 2013

(65) Prior Publication Data

US 2015/0043213 A1 Feb. 12, 2015

(30) Foreign Application Priority Data

Jan. 11, 2012 (CN) ..... 2012 1 0007754

(51) Int. Cl.
*F21V 5/00* (2015.01)
*F21K 99/00* (2016.01)
(Continued)

(52) U.S. Cl.
CPC ..... *F21K 9/1355* (2013.01); *F21K 9/23* (2016.08); *F21V 5/046* (2013.01); *F21V 13/04* (2013.01);
(Continued)

(58) Field of Classification Search
CPC ..... F21V 5/04; F21V 5/043; F21V 5/08; F21V 13/04; G02B 19/0028; G02B 19/0047; F21Y 2101/02
See application file for complete search history.

(56) References Cited

U.S. PATENT DOCUMENTS

| | | | | |
|---|---|---|---|---|
| 7,416,312 | B1 | 8/2008 | McDermott | |
| 2006/0176702 | A1* | 8/2006 | Shen | B60Q 1/2611 362/295 |
| 2007/0268694 | A1* | 11/2007 | Bailey | G02B 27/0955 362/231 |
| 2010/0177262 | A1 | 7/2010 | Kimura et al. | |
| 2010/0232173 | A1* | 9/2010 | Ohno | F21S 2/005 362/538 |

FOREIGN PATENT DOCUMENTS

| | | |
|---|---|---|
| CN | 102141229 A | 8/2011 |
| CN | 102162624 A | 8/2011 |

(Continued)

OTHER PUBLICATIONS

English abstract of FR 2936297 of Mar. 26, 2010.

(Continued)

*Primary Examiner* — Andrew Coughlin
*Assistant Examiner* — Meghan Ulanday
(74) *Attorney, Agent, or Firm* — Viering, Jentschura & Partner mbB

(57) ABSTRACT

A lens for an illumination device, in a cross section, includes a bottom surface, and a first side surface and a second side surface which respectively extend inclinedly upwards from two sides of the bottom surface and converge. The bottom surface includes a supporting surface and an incident surface, the incident surface defining an accommodation cavity for accommodating a light source of the illumination device. The first side surface includes a first emergent surface and a first reflective surface, the second side surface includes a second emergent surface. A first part of light from the incident surface emerges from the first emergent surface, and a second part of light from the incident surface at least emerges from the second emergent surface after reflected by (Continued)

the first reflective surface, such that the emergent light is distributed at an angle of 360°.

18 Claims, 3 Drawing Sheets

(51) Int. Cl.

| | |
|---|---|
| ***F21V 5/04*** | (2006.01) |
| ***F21V 13/04*** | (2006.01) |
| ***F21V 29/70*** | (2015.01) |
| *F21Y 105/00* | (2016.01) |
| *F21Y 101/00* | (2016.01) |

(52) U.S. Cl.
CPC ..... *F21V 29/70* (2015.01); *F21Y 2101/00* (2013.01); *F21Y 2105/001* (2013.01); *F21Y 2105/10* (2016.08); *F21Y 2115/10* (2016.08)

(56) References Cited

FOREIGN PATENT DOCUMENTS

| | | |
|---|---|---|
| EP | 2214046 A1 | 8/2010 |
| FR | 2936297 A1 | 3/2010 |

OTHER PUBLICATIONS

International Search Report issued in the corresponding PCT application No. PCT/EP2013/050063, dated Apr. 3, 2013
European Search Report based on Application No. 13700981.7(5 Pages) dated Aug. 31, 2015 (Reference Purpose Only).
Chinese Search Report based on Application No. 201210007754.0 (1 Page) dated Aug. 18, 2016 (Reference Purpose Only).

* cited by examiner

LENS AND AN ILLUMINATION DEVICE HAVING THE LENS

RELATED APPLICATIONS

The present application is a national stage entry according to 35 U.S.C. §371 of PCT application No.: PCT/EP2013/050063 filed on Jan. 3, 2013, which claims priority from Chinese application No.: 201210007754.0 filed on Jan. 11, 2012, and is incorporated herein by reference in its entirety.

TECHNICAL FIELD

Various embodiments relate to a lens for an illumination device. In addition, various embodiments further relate to an illumination device having the lens.

BACKGROUND

As is known to all, LED illumination has irreplaceable advantages. It is energy saving, has very low power consumption, has a nearly 100% electro-optical power conversion, can save more than 80% of energy with the same illumination efficiency compared with the traditional light source, and has a long lifespan. In view of the above advantages, people more and more frequently use LEDs as light sources, for example, numerous LED retrofit lamps in the market. Such LED retrofit lamps have a profile of a traditional light source such as an incandescent lamp or lamp tube, such that they, as light sources, can be adapted to the existing illumination systems. In the current illumination devices, the LED light sources are widely used.

However, due to the particular configuration of the LED light sources, a single LED light source cannot achieve 360° omnidirectional illumination. In order to achieve omnidirectional illumination, multiple solutions are used in the prior art, for example, with a quite complicated heat sink structures with many LED light sources placed all around the heat sink structures, with phosphor light bulbs, with light guide structures, with reflecting structures inside the bulb. However, various defects exist in the above solutions, for example, having complicated structure, being difficult to assemble, having high cost, or having very low efficiency. In addition, the LED retrofit lamps further need to provide uniform light distribution over a very large area. Especially in the US market, the strict Energy Star criteria have to be met for the luminance intensity distribution.

SUMMARY

In order to solve the above technical problems, the present disclosure provides a lens which enables an illumination device to achieve real 360° omnidirectional illumination, while meeting the requirements of luminance intensity distribution. In addition, various embodiments further provide an illumination device having the lens, the illumination device has a simple structure, can achieve 360° omnidirectional illumination, and has uniform luminance intensity distribution.

The first object of the present disclosure is realized by a lens, viz. in a cross section, the lens includes: a bottom surface; and a first side surface and a second side surface which respectively extend inclinedly upwards from two sides of the bottom surface and converge, wherein the bottom surface includes a supporting surface and an incident surface, the incident surface defining an accommodation cavity for accommodating a light source of the illumination device, wherein the first side surface includes a first emergent surface and a first reflective surface, the second side surface includes a second emergent surface, wherein a first part of light from the incident surface emerges from the first emergent surface, and a second part of light from the incident surface at least emerges from the second emergent surface after reflected by the first reflective surface, such that the emergent light is distributed at an angle of 360°. In the design solution of the present disclosure, the omnidirectional illumination is completely achieved by the lens, and the lens of this type can also achieve uniform luminance intensity distribution.

According to various embodiments, the lens is configured to be a ring shape, and is rotationally symmetrical with respect to an axis which is perpendicular to the bottom surface. The ring lens enables the light emerging from the lens to complement each other in a circumferential direction, so as to achieve real omnidirectional illumination.

Preferably, the second side surface further includes a second reflective surface, the second part of light from the incident surface at least partially emerges from the second emergent surface after reflected by the second reflective surface and the first reflective surface in sequence.

In the design solution of the present disclosure, the second reflective surface can adjust the angle at which a part of light emerges from the second emergent surface, such that at least part of the light emerging from the second emergent surface deflects towards the back of the lens, viz. a direction opposite to the emerging direction of the light of the light source, so as to meet the requirements of omnidirectional illumination.

Further preferably, the incident surface includes a first incident surface portion, a second incident surface portion, and a third incident surface portion, wherein a first part of light from the light source incidents into the first incident surface portion and emerges after refracted by the first emergent surface, and one part of a second part of light from the light source incidents into the second incident surface portion and emerges from the second emergent surface after reflected by the first reflective surface, and the other part of the second part of light from the light source incidents into the third incident surface portion and emerges from the second emergent surface after reflected by the second reflective surface and the first reflective surface in sequence. In the design solution of the present disclosure, the first incident surface portion and the first emergent surface refract a part of the light of the light source, such that the light from the light source deflects to the left side of the optical axis of the light source, and the second incident surface portion, the third incident surface portion, the first reflective surface, the second reflective surface, and the second emergent surface carry out refraction and at least one reflection for the rest light of the light source, such that the light of the light source deflects in a direction of the other side of the optical axis of the light source, and further deflects towards the back of the lens, viz. a direction opposite to the emerging direction of the light of the light source, so as to achieve omnidirectional illumination.

Preferably, a side of the first reflective surface is connected with the second reflective surface via the second emergent surface, wherein the first reflective surface and the second reflective surface are arranged to partially face each other. In this way, the light from the second reflective surface can be reflected to the first reflective surface, and emerges from the second emergent surface.

Advantageously, the other side of the first reflective surface is connected with the supporting surface via the first emergent surface, the supporting surface is connected with the second incident surface portion via the first incident surface portion, and the second incident surface portion is connected with the second reflective surface via the third incident surface portion.

According to the design solution of the present disclosure, in the cross section, the second reflective surface is arranged to be inclined with respect to the axis, and forms an angle with the third incident surface portion, wherein an angle between a tangential direction of the second reflective surface and the bottom surface is greater than 90°. By adjusting the angle of the second reflective surface with respect to the bottom surface, the emerging angle of the light emerging from the second emergent surface can be changed.

Advantageously, in the cross section, the first incident surface portion is configured as a concave surface recessed away the light source, and the second incident surface portion is configured as a convex surface projecting towards the light source, wherein the concave surface and the convex surface are in a smooth transition.

Preferably, in the cross section, the third incident surface portion is in a linear shape and is arranged to be inclined with respect to the axis in a direction apart from the second side surface, wherein an angle between the second incident surface portion and the axis is between 2°-5°.

Optionally, the first emergent surface, the first reflective surface, the second emergent surface, and the second reflective surface are in a shape of spline curve in the cross section. In the design solution of the present disclosure, the first emergent surface is used for allocating light energy of the light from the first incident surface portion, and the first reflective surface is used for reflecting the light collimated by the second incident surface and the second reflective surface.

Advantageously, the first emergent surface, the first reflective surface, the second emergent surface, and the second reflective surface are in a shape of rational quadric Bezier curve in the cross section, wherein the rational quadric Bezier curve can be defined by the equation:

$$p(t) = \frac{(1-t)^2 w_0 v_0 + 2t(1-t) w_1 v_1 + t^2 w_2 v_2}{(1-t)^2 w_0 + 2t(1-t) w_2 + t^2 w_2}, 0 \le t \le 1,$$

where $v_0$, $v_1$, $v_2$ are pre-determined control vertexes, and $w_0$, $_w1$, $w_2$ are predefined weights.

In the design solution of the present disclosure, the second incident surface portion is in a shape of spline curve, conic, or arc in the cross section, which collimates the light from the light source, so as to ensure that the light refracted by the second incident surface portion can emerge vertically.

Optionally, the first incident surface portion is in an arc-shape which is tangent to the second incident surface portion in the cross section.

Various embodiments provide an illumination device having a lens of the above type. The illumination device according to the present disclosure can achieve 360° omnidirectional illumination, has a simple structure, and has uniform luminance intensity distribution.

According to various embodiments, the illumination device further includes: a heat sink, an electronic assembly provided at one side of the heat sink, an LED light-emitting assembly provided at the other side of the heat sink, and a transparent bulb which defines, together with the other side of the heat sink, an accommodation space.

Preferably, the LED light-emitting assembly includes a printed circuit board and a plurality of LED chips which are uniformly arranged in a ring shape in the vicinity of a circumferential edge of the printed circuit board. The luminance intensity of the illumination device can be enhanced by using a plurality of LED chips, and the plurality of LED chips which are arranged rotationally symmetrical can cooperate with the lens of the present disclosure to achieve 360° omnidirectional illumination. According to various embodiments, a supporting surface of the lens is supported on the other side of the heat sink, and a second side surface of the lens is arranged such that a projection of the second side surface on the other side of the heat sink does not overlap a projection of the heat sink. In this way, the light emerging from the second emergent surface will not be blocked by the heat sink, which thereby ensures 360° omnidirectional illumination.

Preferably, the lens is fully enclosed in the accommodation space. The bulb can protect the lens, so as to prevent dirt from adhering to the lens to affect the optical properties of the lens.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
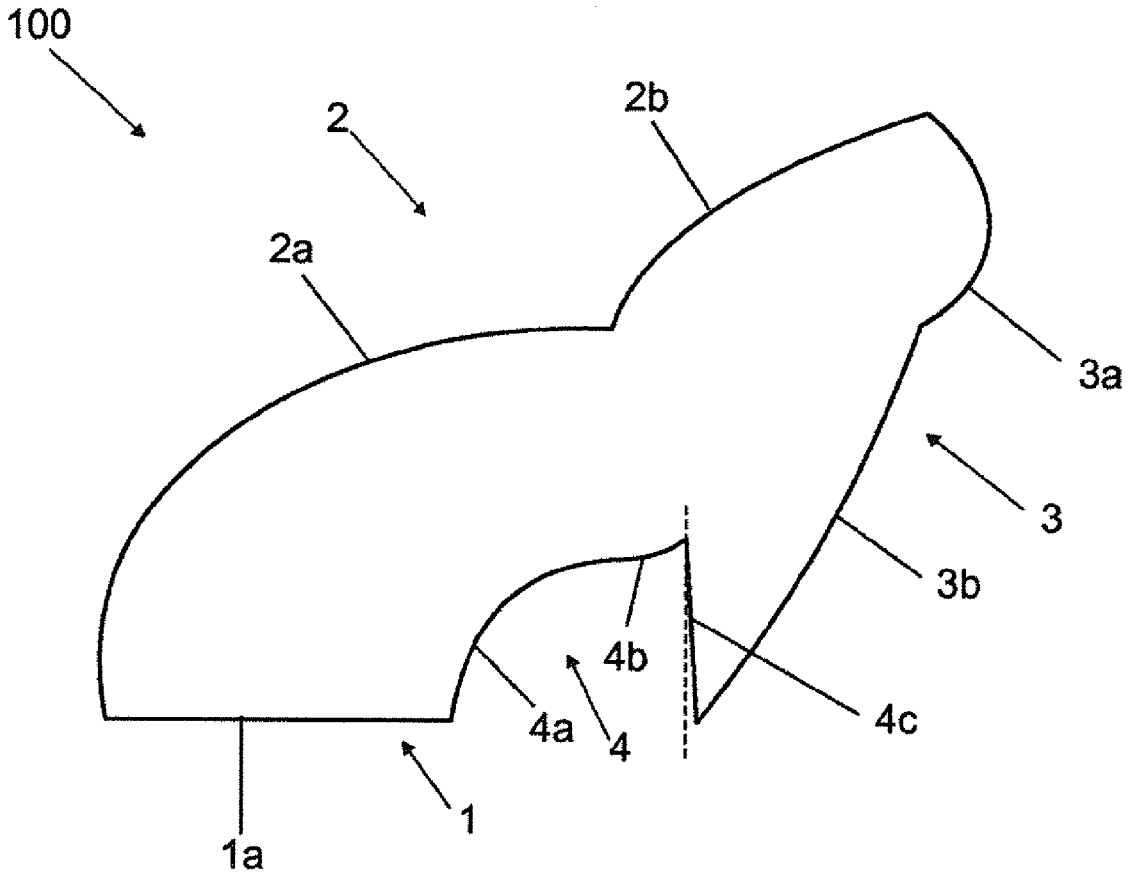
FIG. 1 is a sectional view of the lens according to the present disclosure.

FIG. 1 is a sectional view of the lens according to the present disclosure. As can be seen from the figure, the lens 100 comprises: a bottom surface 1; and a first side surface 2 and a second side surface 3 which respectively extend inclinedly upwards from two sides of the bottom surface 1 and converge, wherein the bottom surface 1 comprises a supporting surface 1*a* and an incident surface 4, the incident surface 4 defining an accommodation cavity for accommodating a light source of the illumination device, wherein the first side surface 2 comprises a first emergent surface 2*a* and a first reflective surface 2*b*, the second side surface 3 comprises a second emergent surface 3*a*, wherein a first part of light from the incident surface 4 emerges from the first emergent surface 2*a*, and a second part of light from the incident surface 4 at least emerges from the second emergent surface 3*a* after reflected by the first reflective surface 2*b*, such that the emergent light is distributed at an angle of 360°.

As can be seen from the figure, the second side surface 3 further comprises a second reflective surface 3*b*, the second part of light from the incident surface 4 at least partially emerges from the second emergent surface 3*a* after reflected by the second reflective surface 3*b* and the first reflective surface 2*b* in sequence. In addition, the incident surface 4 comprises a first incident surface portion 4*a*, a second incident surface portion 4*b*, and a third incident surface portion 4*c*.

In the present embodiment, the first incident surface portion 4*a* is configured as a concave surface recessed away the light source, and the second incident surface portion 4*b* is configured as a convex surface projecting towards the light source, wherein the concave surface and the convex surface are in a smooth transition. In the present embodiment, the first reflective surface 2*b* is connected with the second reflective surface 3*b* via the second emergent surface 3*a*, wherein the first reflective surface 2*b* and the second reflective surface 3*b* are arranged to partially face each other, the first reflective surface 2*b* is connected with the supporting surface 1*a* via the first emergent surface 2*a*, the supporting surface 1*a* is connected with the second incident surface portion 4*b* via the first incident surface portion 4*a*, and the second incident surface portion 4*b* is connected with the second reflective surface 3*b* via the third incident surface portion 4*c*.

As can be further seen from the figure, the second reflective surface 3*b* is arranged to be inclined with respect to the axis, and forms an angle with the third incident surface portion 4*c*, wherein an angle between a tangential direction of the second reflective surface 3*b* and the bottom surface 1 is greater than 90°. In addition, the third incident surface portion 4*c* is in a linear shape and is arranged to be inclined with respect to the axis in a direction apart from the second side surface 3, wherein an angle between the second incident surface portion 4*b* and the axis is between 2°-5°.

In the present embodiment, the first emergent surface 2*a*, the first reflective surface 2*b*, the second emergent surface 3*a*, and the second reflective surface 3*b* are in a shape of spline curve in the cross section. In addition, the first emergent surface 2*a*, the first reflective surface 2*b*, the second emergent surface 3*a*, and the second reflective surface 3*b* are in a shape of rational quadric Bezier curve in the cross section, and the rational quadric Bezier curve can be defined by the equation:

$$p(t) = \frac{(1-t)^2 w_0 v_0 + 2t(1-t) w_1 v_1 + t^2 w_2 v_2}{(1-t)^2 w_0 + 2t(1-t) w_2 + t^2 w_2}, \; 0 \le t \le 1$$

where $v_0$, $v_1$, $v_2$ are predetermined control vertexes, and $w_0$, $w_1$, $w_2$ are predefined weights.

In addition, the second incident surface portion is in a shape of spline curve, conic, or arc in the cross section.

Figure 2:
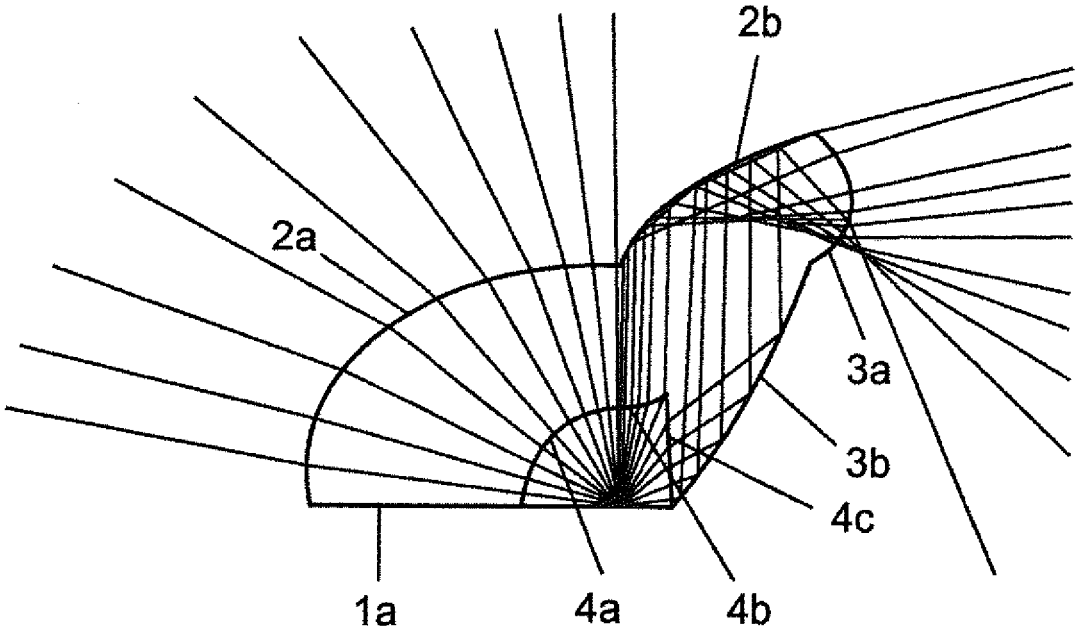
FIG. 2 is an optical pathway diagram of the lens according to the present disclosure.

FIG. 2 is an optical pathway diagram of the lens 100 according to the present disclosure. As can be seen from the figure, a first part of light from the light source incidents into the first incident surface portion 4*a* and emerges after refracted by the first emergent surface 2*a*, and one part of a second part of light from the light source incidents into the second incident surface portion 4*b* and emerges from the second emergent surface 3*a* after reflected by the first reflective surface 2*b*, and the other part of the second part of light from the light source incidents into the third incident surface portion 4*c* and emerges from the second emergent surface 3*a* after reflected by the second reflective surface 3*b* and the first reflective surface 2*b*, so as to achieve omnidirectional illumination.

Figure 3:
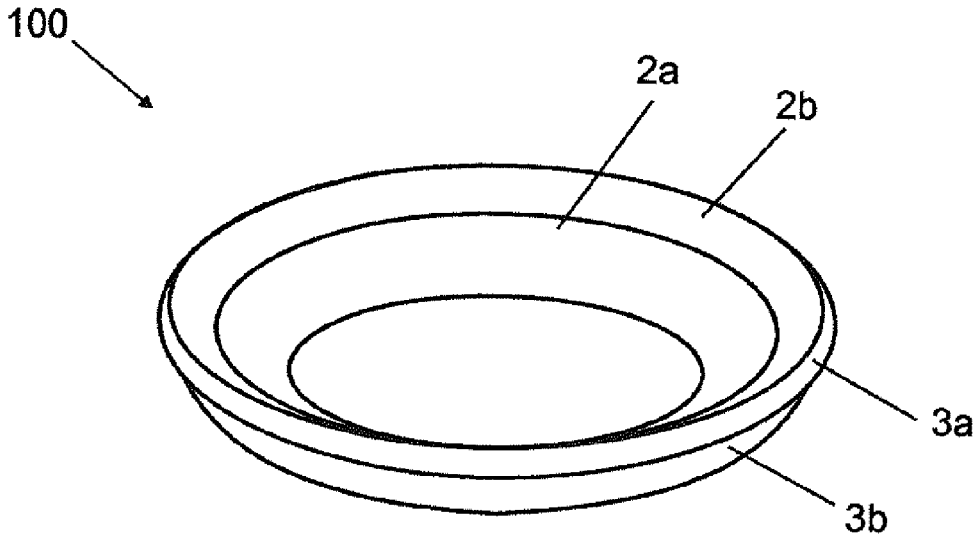
FIG. 3 is a 3D schematic diagram of the lens according to the present disclosure.

FIG. 3 is a 3D schematic diagram of the lens 100 according to the present disclosure. As can be seen from the figure, the lens 100 is configured in a ring shape, and is rotationally symmetrical with respect to an axis which is perpendicular to the bottom surface 1. In this way, the light emerging from the lens 100 can complement each other in a circumferential direction, so as to achieve real omnidirectional illumination and provide uniform luminance intensity distribution.

Figure 4:
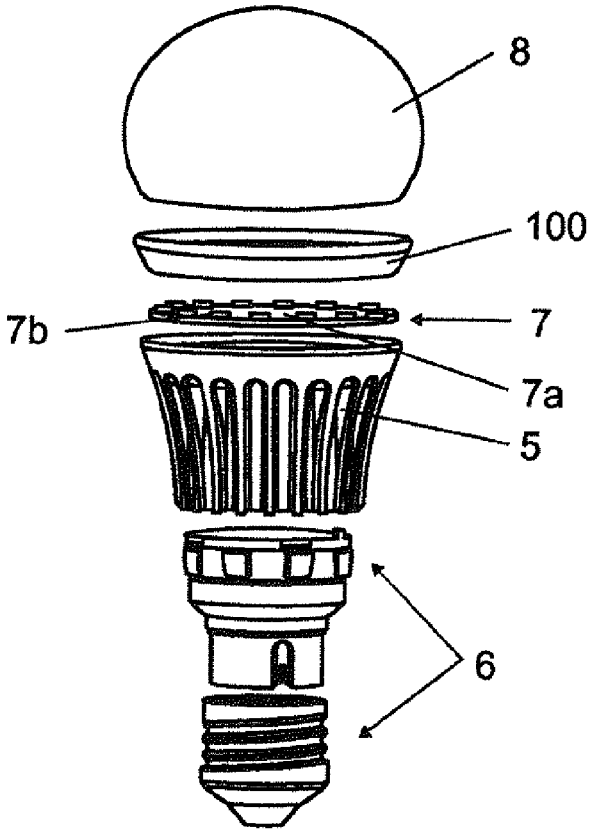
FIG. 4 is an exploded schematic diagram of the illumination device according to the present disclosure.

FIG. 4 is an exploded schematic diagram of the illumination device according to the present disclosure. As can be seen from the figure, the illumination device comprises: a heat sink 5, an electronic assembly 6 provided at one side of the heat sink 5, an LED light-emitting assembly 7 provided at the other side of the heat sink 5, and a transparent bulb 8 which defines, together with the other side of the heat sink 5, an accommodation space. As can be further seen from the figure, the LED light-emitting assembly 7 comprises a printed circuit board 7*a* and a plurality of LED chips 7*b* which are uniformly arranged in a ring shape in the vicinity of a circumferential edge of the printed circuit board 7*a*, wherein the lens 100 according to the present disclosure is disposed above the printed circuit board 7*a*, such that the LED chips 7*b* are located in the accommodation cavity of the lens 100, and the supporting surface 1*a* of the lens 100 is supported on the heat sink 5. Further, a second side surface 3 of the lens 100 is arranged such that a projection of the second side surface 3 on the other side of the heat sink 5 does not overlap a projection of the heat sink 5, and in an assembled state, the lens 100 is fully enclosed in the accommodation space defined by the bulb 8 and the heat sink 5.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

100 lens
1 bottom surface
1*a* supporting surface
2 first side surface
2*a* first emergent surface
2*b* first reflective surface
3 second side surface
3*a* second emergent surface
3*b* second reflective surface
4 incident surface
4*a* first incident surface portion
4*b* second incident surface portion
4*c* third incident surface portion
5 heat sink
6 electronic assembly
7 LED light-emitting assembly
7*a* printed circuit board
7*b* LED chip
8 bulb

The invention claimed is:

1. A lens for an illumination device, in a cross section, the lens comprising:

a bottom surface; and a first side surface and a second side surface which respectively extend inclinedly upwards from two sides of the bottom surface and converge, wherein the bottom surface comprises a supporting surface and an incident surface, the incident surface defining an accommodation cavity for accommodating a light source of the illumination device, wherein the first side surface comprises a first emergent surface and a first reflective surface, the second side surface comprises a second emergent surface, wherein a first part of light from the incident surface emerges from the first emergent surface, and a second part of light from the incident surface at least emerges from the second emergent surface after reflected by the first reflective surface, such that the emergent light is distributed at an angle of 360°.

2. The lens according to claim 1, wherein the lens is configured to be a ring shape, and is rotationally symmetrical with respect to an axis which is perpendicular to the bottom surface.

3. The lens according to claim 2, wherein the second side surface further comprises a second reflective surface, the second part of light from the incident surface at least partially emerges from the second emergent surface after reflected by the second reflective surface and the first reflective surface in sequence.

4. An illumination device comprising a lens the lens comprising:

a bottom surface; and a first side surface and a second side surface which respectively extend inclinedly upwards from two sides of the bottom surface and converge, wherein the bottom surface comprises a supporting surface and an incident surface, the incident surface defining an accommodation cavity for accommodating a light source of the illumination device, wherein the first side surface comprises a first emergent surface and a first reflective surface, the second side surface comprises a second emergent surface, wherein a first part of light from the incident surface emerges from the first emergent surface, and a second part of light from the incident surface at least emerges from the second emergent surface after reflected by the first reflective surface, such that the emergent light is distributed at an angle of 360°, wherein the supporting surface of the lens is supported on the other side of the heat sink, and the second side surface of the lens is arranged such that a projection of the second side surface on the other side of the heat sink does not overlap a projection of the heat sink.

5. The illumination device according to claim 4, wherein the illumination device further comprises: a heat sink, an electronic assembly provided at one side of the heat sink, an LED light-emitting assembly provided at the other side of the heat sink, and a transparent bulb which defines, together with the other side of the heat sink, an accommodation space.

6. The illumination device according to claim 5, wherein the LED light-emitting assembly comprises a printed circuit board and a plurality of LED chips which are uniformly arranged in a ring shape in the vicinity of a circumferential edge of the printed circuit board.

7. The illumination device according to claim 5, wherein the lens is fully enclosed in the accommodation space.

8. A lens for an illumination device, in a cross section, the lens comprising:

a bottom surface; and a first side surface and a second side surface which respectively extend inclinedly upwards from two sides of the bottom surface and converge, wherein the bottom surface comprises a supporting surface and an incident surface, the incident surface defining an accommodation cavity for accommodating a light source of the illumination device, wherein the first side surface comprises a first emergent surface and a first reflective surface, the second side surface comprises a second emergent surface, wherein a first part of light from the incident surface emerges from the first emergent surface, and a second part of light from the incident surface at least emerges from the second emergent surface after reflected by the first reflective surface, such that the emergent light is distributed at an angle of 360°, wherein the lens is configured to be a ring shape, and is rotationally symmetrical with respect to an axis which is perpendicular to the bottom surface, wherein the second side surface further comprises a second reflective surface, the second part of light from the incident surface at least partially emerges from the second emergent surface after reflected by the second reflective surface and the first reflective surface in sequence, wherein the incident surface comprises a first incident surface portion, a second incident surface portion, and a third incident surface portion, wherein a first part of light from the light source incidents into the first incident surface portion and emerges after refracted by the first emergent surface, and one part of a second part of light from the light source incidents into the second incident surface portion and emerges from the second emergent surface after reflected by the first reflective surface, and the other part of the second part of light from the light source incidents into the third incident surface portion and emerges from the second emergent surface after reflected by the second reflective surface and the first reflective surface in sequence.

9. The lens according to claim 8, wherein a side of the first reflective surface is connected with the second reflective surface via the second emergent surface, wherein the first reflective surface and the second reflective surface are arranged to partially face each other.

10. The lens according to claim 9, wherein the first reflective surface is connected with the supporting surface via the first emergent surface, the supporting surface is connected with the second incident surface portion via the first incident surface portion, and the second incident surface portion is connected with the second reflective surface via the third incident surface portion.

11. The lens according to claim 9, wherein in the cross section, the second reflective surface is arranged to be inclined with respect to the axis, and forms an angle with the third incident surface portion, wherein an angle between a tangential direction of the second reflective surface and the bottom surface is greater than 90°.

12. The lens according to claim 8, wherein in the cross section, the first incident surface portion is configured as a concave surface recessed away the light source, and the second incident surface portion is configured as a convex surface projecting towards the light source, wherein the concave surface and the convex surface are in a smooth transition.

13. The lens according to claim 8, wherein in the cross section, the third incident surface portion is in a linear shape and is arranged to be inclined with respect to the axis in a direction apart from the second side surface, wherein an angle between the second incident surface portion and the axis is between 2°-5°.

14. The lens according to claim 8, wherein the first emergent surface, the first reflective surface, the second emergent surface, and the second reflective surface are in a shape of spline curve in the cross section.

15. The lens according to claim 8, wherein the first emergent surface, the first reflective surface, the second emergent surface, and the second reflective surface are in a shape of rational quadric Bezier curve in the cross section.

16. The lens according to claim 15, characterized in that, the rational quadric Bezier curve can be defined by the equation:

$$p(t) = \frac{(1-t)^2 w_0 v_0 + 2t(1-t) w_1 v_1 + t^2 w_2 v_2}{(1-t)^2 w_0 + 2t(1-t) w_2 + t^2 w_2}, 0 \le t \le 1,$$

where $v_0$, $v_1$, $v_2$ are predetermined control vertexes, and $w_0$, $w_1$, $w_2$ are predefined weights.

17. The lens according to claim 8, wherein the second incident surface portion is in a shape of spline curve, conic, or arc in the cross section.

18. The lens according to claim 8, wherein the first incident surface portion is in an arc-shape which is tangent to the second incident surface portion in the cross section.

* * * * *